US008678781B2

(12) United States Patent
Imagawa et al.

(10) Patent No.: US 8,678,781 B2
(45) Date of Patent: Mar. 25, 2014

(54) ANGULAR OSCILLATION CENTRIFUGAL PUMP

(75) Inventors: Takahito Imagawa, Nagoya (JP); Atsunori Miyamura, Kasugai (JP)

(73) Assignee: Imagina Holdings Co., Ltd., Aichi-ken (JP)

( * ) Notice: Subject to any disclaimer, the term of this patent is extended or adjusted under 35 U.S.C. 154(b) by 587 days.

(21) Appl. No.: 12/577,977

(22) Filed: Oct. 13, 2009

(65) Prior Publication Data

US 2010/0247354 A1 Sep. 30, 2010

(30) Foreign Application Priority Data

Mar. 27, 2009 (JP) ..... 2009-080233
Jul. 9, 2009 (JP) ..... 2009-163133

(51) Int. Cl.
*F04B 17/00* (2006.01)
*F04B 35/04* (2006.01)

(52) U.S. Cl.
USPC ..... 417/356; 417/423.7; 417/423.1; 417/355

(58) Field of Classification Search
USPC ..... 417/423.1, 423.7, 420, 355, 356, 357; 415/64, 203, 80, 90, 146; 384/119; 416/79, 80, 81
See application file for complete search history.

(56) References Cited

U.S. PATENT DOCUMENTS 3,143,970 A * 8/1964 Bodine, Jr. ..... 417/53
3,894,817 A * 7/1975 Majoros et al. ..... 417/415
4,381,181 A * 4/1983 Clegg ..... 417/423.7
5,044,897 A * 9/1991 Dorman ..... 417/423.7
5,405,251 A * 4/1995 Sipin ..... 417/420
6,186,665 B1 * 2/2001 Maher et al. ..... 384/206
6,210,103 B1 * 4/2001 Ramsay ..... 415/112
6,626,644 B2 * 9/2003 Ozaki ..... 417/45
7,097,434 B2 * 8/2006 Marioni ..... 417/423.1
7,189,260 B2 * 3/2007 Horvath et al. ..... 623/3.13
2005/0147510 A1 * 7/2005 Marioni ..... 417/423.6
2008/0211435 A1 * 9/2008 Imagawa ..... 318/130

FOREIGN PATENT DOCUMENTS

JP 2004-060640 2/2004
JP 2007-289911 11/2007
JP 2008-212912 9/2008
JP 2008-2129112 9/2008
JP 2009-011767 1/2009

* cited by examiner

*Primary Examiner* — Charles Freay
*Assistant Examiner* — Alexander Comley
(74) *Attorney, Agent, or Firm* — Sheridan Ross P.C.

(57) ABSTRACT

A turbo type centrifugal pump is provided in which an angular oscillator is angularly oscillated so that fluid in a radial through hole receives centrifugal force. The angular oscillator is used in combination with a resonance oscillation motor that generates angular oscillation. The resonance oscillation motor is incorporated in the pump so that the pump structure and the drive mechanism are integrated. This reduces the size of the pump. Since the angular oscillation is a reciprocating rotation within an oscillation range less than 360°, a suction pipe can be connected to the radial through hole used in the angular oscillation. This eliminates the necessity for providing a shielding structure.

10 Claims, 7 Drawing Sheets

ANGULAR OSCILLATION CENTRIFUGAL PUMP

CROSS-REFERENCE TO RELATED APPLICATIONS

This application claims the benefit of Japanese Patent Application No. 2009-080233 filed Mar. 27, 2009, and Japanese Patent Application No. 2009-163133 filed Jul. 9, 2009, the entire contents of each of which are incorporated by reference herein.

BACKGROUND OF THE INVENTION

The present invention relates to a device that converts an electric current to pump pressure.

Positive displacement pumps and turbopumps are commonly used as fluid pumps. Japanese Laid-Open Patent Publication No. 2004-060640 discloses a diaphragm pump, which is a type of positive displacement pump, and Japanese Laid-Open Patent Publication No. 2009-011767 discloses a centrifugal pump, which is a type of turbopump.

A positive displacement pump requires a valve structure, or a shielding mechanism for a valve. When deteriorated, shielding mechanisms adversely affect the pump performance. Thus, the energy conversion efficiency of positive displacement pumps is lower than that of turbopumps. In contrast, turbopumps are superior in energy conversion efficiency and have a wide application range for the flow rate and discharge pressure. However, since a drive motor is attached to the outside of the pump, the overall size of a turbopump tends to be large. Further, a typical turbopump requires a shaft shielding mechanism for preventing liquid leakage (fluid leaks) about the shaft. To eliminate the shaft shield, a magnetic shaft may be used. However, a magnetic shaft requires an advanced type of magnetic control mechanism. Also, Japanese Laid-Open Patent Publication No. 2007-289911 does not disclose the details for an embodiment when the invention is used in a pump.

SUMMARY

Accordingly, it is an objective of the present invention to provide a turbopump that requires no valve and has a simple structure suitable for miniaturization, and further to provide a pump structure requiring no shaft shield.

In accordance with one aspect of the present invention, an angular oscillation centrifugal pump is provided that includes a case, an angular oscillator accommodated in the case to be rotatable in a reciprocating manner, a retaining portion that is provided in the case to retain the angular oscillator, and an electromagnetic coil provided in the case. The angular oscillator has a first magnetic dipole and a pressure feed passage. The pressure feed passage has a pressure feed inlet for receiving fluid and a pressure feed outlet for discharging the fluid. The retaining portion retains the angular oscillator based on magnetic force generated by the first magnetic dipole. The retaining portion includes a second magnetic dipole or a magnetic body. The angular oscillator is oscillatable relative to the retaining portion. The magnetic force defines a rest point for the oscillation of the angular oscillator and the natural frequency of the oscillation. When a current that is synchronized with the natural frequency is supplied to the electromagnetic coil, the angular oscillator is resonated. As a result, fluid in the pressure feed passage receives centrifugal force, so that the fluid is discharged from the pressure feed outlet.

Since the invention of claim 1 provides a turbopump requiring no valve, claim 1 is superior to positive displacement pumps. A conventional centrifugal pump requires a drive unit at the outside of the pump structure. In contrast, since the centrifugal pump of the present invention has a resonance oscillation motor incorporated therein, the pump structure and the drive mechanism are integrated. This structure is suitable for miniaturization. Further, a pump with a perfect shield performance with no fluid leakage can be provided. Since the angular oscillation of the angular oscillator is a reciprocating rotation within a range less than 360°, no structure for shielding the rotary shaft is required. Further, the pump of the present invention is simple and easy to manufacture, and also has a small number of failure factors. Also, as shown in table 2 shown below, the output performance is high for the size of the pump, and the pump performance can be designed for a wide range.

According to the invention of claim 2, an angular oscillator as shown in FIGS. 1(*a*) to 3(*d*) can be easily manufactured. According to the invention of claim 3, if the first magnetic dipole is located close to the axis, the moment of inertia of the angular oscillator is reduced, that is, the natural frequency can be increased. On the other hand, when the radius of the oscillator disk is increased, the radial through hole is elongated, so that a great centrifugal force can be applied to fluid in the radial through hole. According to the invention of claim 4, a centrifugal pump in which bearing portions are isolated from the carrier fluid as shown in FIGS. 5(*a*) and 5(*b*). Thus, particles contained in fluid (for example, red blood cells in blood) are prevented from being mashed by bearing portions. The pump is therefore suitable for a heart pump. According to the invention of claim 5, the resonance oscillation of the oscillator disk is smoothly continued. According to the invention of claim 6, fluid that has been discharged from the radial through hole is conveyed to the outside without being stirred in the case as shown in FIGS. 3(*a*) to 3(*d*). This reduces the energy loss. According to the invention of claim 7, the shielding performance against fluid leak is improved. According to claim 8 of the present invention, the moment of inertia of the angular oscillator is reduced while elongating the radial through hole as shown in FIGS. 4(*a*) and 4(*b*) to increase the centrifugal force. This improves the pump efficiency. According to the invention of claim 9, an air pump that feeds a great number of fine bubbles into water is provided.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 1(*b*) is a cross-sectional view taken along line 1B-1B of FIG. 1(*a*);

FIG. 1(*c*) is a longitudinal cross-sectional view;

FIG. 2(*b*) is a cross-sectional view taken along line 2B-2B of FIG. 2(*a*);

FIG. 2(*c*) is a longitudinal cross-sectional view;

FIG. 2(*d*) is a cross-sectional plan view showing an operation;

FIG. 3(*b*) is a cross-sectional view taken along line 3B-3B of FIG. 3(*a*);

FIG. 3(*c*) is a longitudinal cross-sectional view;

FIG. 3(*d*) is a cross-sectional plan view showing an operation;

FIG. 4(*b*) is a cross-sectional view taken along line 4B-4B of FIG. 4(*a*);

FIG. 5(*b*) is a cross-sectional view taken along line 5B-5B of FIG. 5(*a*);

FIG. 7(*b*) is a cross-sectional view taken along line 7B-7B of FIG. 7(*a*).

DESCRIPTION OF THE PREFERRED EMBODIMENTS

Figure 1:
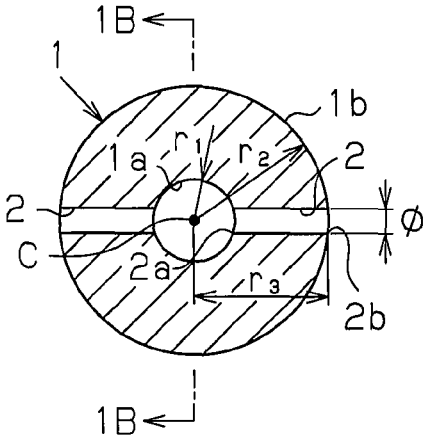
FIG. 1(*a*) is a cross-sectional plan view of an angular oscillator shown in FIG. 2(*a*)
Figure 1:
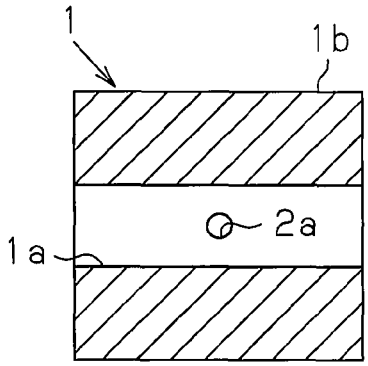
Figure 1:
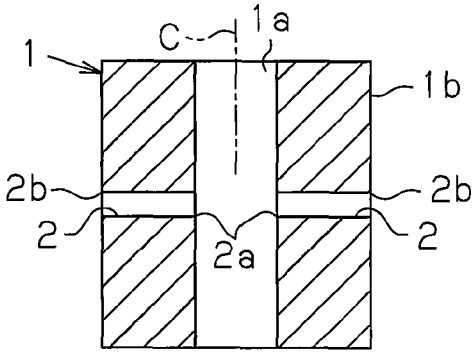
Figure 2A:
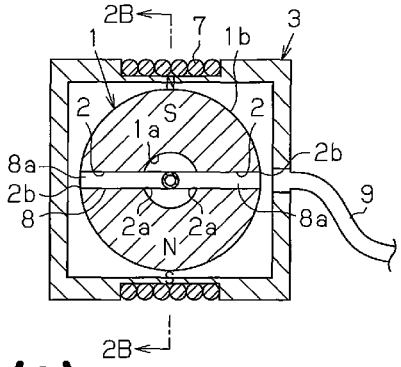
FIG. 2(*a*) is a cross-sectional plan view illustrating an angular oscillation centrifugal pump according to a first embodiment of the present invention.
Figure 2B:
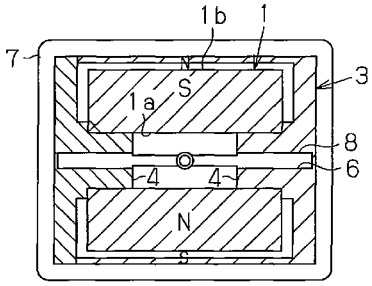
Figure 2C:
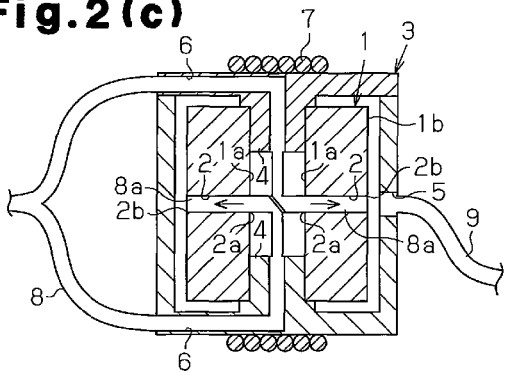
Figure 2D:
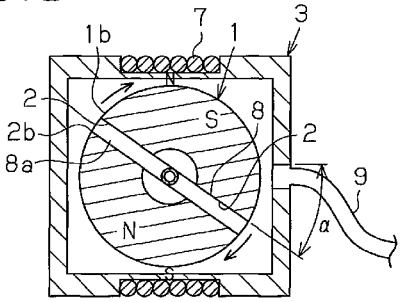
Figure 3A:
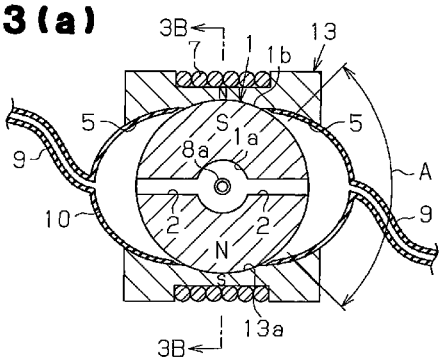
FIG. 3(*a*) is a cross-sectional plan view of a centrifugal pump according to a second embodiment, which has an improved energy conversion efficiency.
Figure 3B:
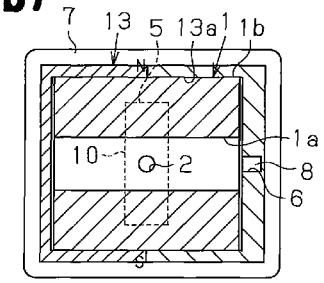
Figure 3C:
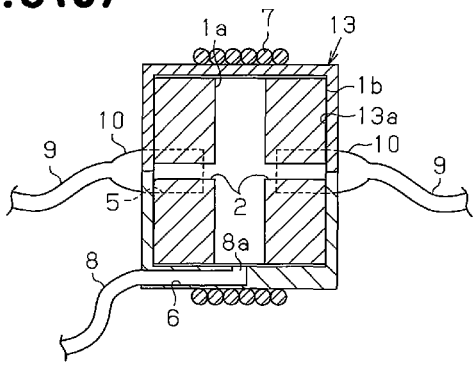
Figure 3D:
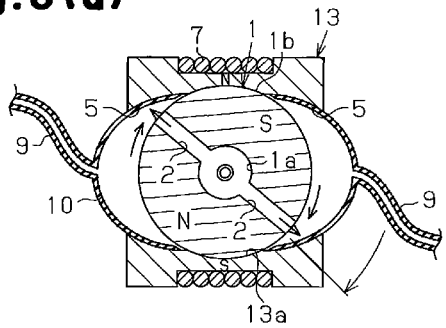

As shown in FIGS. 1(*a*) to 1(*c*), an angular oscillator 1, which is a hollow cylinder, has an axial hole 1*a*, which is a through hole extending in the axial direction. The angular oscillator 1 also has two radial through holes 2, each extending from the axial hole 1*a* to an outer circumferential surface 1*b*. The two radial through holes 2 are formed to extend along a single line that crosses the angular oscillator 1 and passes through the axis C of the angular oscillator 1. When the angular oscillator 1 is caused to angularly oscillate about the axis C, which is the center of the cylinder, the radial through holes 2 function as pressure feed passages, so that fluid in the radial through holes 2 is moved under pressure by the centrifugal force and discharged to the outside of the angular oscillator 1. The angular oscillation is defined as a periodic repetition of forward rotation and reverse rotation within a rotation motion range less than 360°. FIG. 1(*a*) also shows the inner diameter $r_1$ and the outer diameter $r_2$ of the angular oscillator 1.

FIGS. 2(*a*) to 2(*c*) show an angular oscillation centrifugal pump according to a first embodiment that has a structure for causing the angular oscillator 1 to angularly oscillate. The centrifugal pump incorporates the resonance oscillation motor of Japanese Laid-Open Patent Publication No. 2007-289911.

The angular oscillator 1 is accommodated in a case 3, which is formed as a hollow box. The case 3 has a pair of bearing portions 4, which are partly located in the axial hole 1*a* of the angular oscillator 1 to rotatably support the angular oscillator 1. Contacting portions of the inner circumferential surface of the axial hole 1*a* and the outer circumferential surface of the bearing portions 4 are subjected to surface treatment so that the angular oscillator 1 smoothly performs angular oscillation.

The case 3 further has an outlet opening 5, to which a discharge pipe 9 is connected, and two suction openings 6, which extend from the outside of the case 3 to the axial hole 1*a* through the bearing portions 4. With the discharge pipe 9 received in the outlet opening 5, hermetic sealing treatment is applied to the periphery of the outlet opening 5 to disconnect the interior of the case 3 from the outside. A suction pipe 8 is branched into two outside the case 3, and each branch passes through the corresponding suction opening 6, extends through the axial hole 1*a* of the angular oscillator 1, and is connected to one of the radial through holes 2. In the present embodiment, the branches of the suction pipe 8 are inserted in the radial through holes 2 and extend to the outer circumferential surface 1*b* of the angular oscillator 1. Since the distal ends 8*a* of the suction pipe 8 are required to be deformed smoothly in response to angular oscillation of the radial through holes 2, the suction pipe 8 is preferably made of soft material, such as a silicone rubber pipe. As a result, the suction pipe 8 is capable of continuously supplying fluid to the radial through holes 2 during angular oscillation. That is, since the suction pipe 8 extends from the suction openings 6 to the radial through holes 2, the centrifugal pump exerts a perfect shielding performance against fluid leakage. The radially inner end of each radial through hole 2 is referred to as a pressure feed inlet 2*a*, and the radially outer end of each radial through hole 2 is referred to as a pressure feed outlet 2*b*. The pressure feed inlets 2*a* are connected to the suction openings 6 to receive fluid from the suction openings 6 by the suction pipe 8. The pressure feed outlets 2*b* are connected to the discharge openings 5 so as to send fluid to the discharge openings 5 through the interior of the case 3.

A magnet is used as the angular oscillator 1, so that it functions as a first magnetic dipole. A magnet is embedded in the case 3 so that the case 3 functions as a second magnetic dipole. The second magnetic dipole is a retainer (stator) that retains the angular oscillator 1 based on the magnetic force of the first magnetic dipole. A nonmagnetic member may be used as the angular oscillator 1. In this case, a magnet is embedded in the angular oscillator 1 so that it functions as the first magnetic dipole. Further, a magnet may be used as the case 3 itself, so that it functions as the second magnetic dipole.

The magnetic field of the first magnetic dipole and the magnetic field of the second magnetic dipole interact with each other to determine the stable position of the angular oscillator 1, or the rest point of oscillation. For example, as shown in FIGS. 2(*a*) and 2(*b*), the first magnetic dipole is formed such that the upper half of the outer circumferential surface 1*b* of the angular oscillator 1 acts as a south pole, and the lower half of the outer circumferential surface 1*b* acts as a north pole. The case 3 is formed such that a portion that faces the south pole of the angular oscillator 1 acts as a north pole, and a portion that faces the north pole of the angular oscillator 1 acts as a south pole.

For example, in a case where FIG. 2(*a*) shows a stable position of the angular oscillator 1, if the angular oscillator 1 receives a rotating force about the axis C, the angular oscillator 1 is rotated about the axis C as shown in FIG. 2(*d*) in accordance with the direction of forces in the case 3. When the forces cease to act, the angular oscillator 1 returns to the stable position shown in FIG. 2(*a*). That is, the angular oscillator 1 oscillates about the rest point and eventually returns to the rest point when no force is acting. The angular oscillator 1 forms an oscillating system inside the case 3.

It is sufficient if the radial through holes 2 extend from the axial hole 1*a*, which extends along the axis C of the angular oscillator 1, to the outer circumferential surface 1*b*. The stable position of the angular oscillator 1 may be any rotational position about the axis C. This is because when the angular oscillator 1 angularly oscillates, centrifugal force acts on fluid in the radial through holes 2, so that pump action is generated.

An oscillating system has a natural frequency, which can be adjusted by changing the shapes, arrangement, and the intensity of the magnets of the first magnetic dipole and second magnetic dipole. Further, the natural frequency changes in accordance with the load on the angular oscillator 1. When the angular oscillator 1 angularly oscillates, the change in the angular velocity, which is determined by the shapes, arrangement and the magnet intensity of the first magnetic dipole and second magnetic dipole, generally approximates to a sine wave corresponding to the rotational angle.

The second magnetic dipole of the case 3 may be a magnetic body that is not a magnet. That is, it is sufficient if the magnetic filed generated by the angular oscillator 1 acts on the magnetic body of the case 3, so that the rest point of the angular oscillator 1 is defined. The second magnetic dipole or the magnetic body of the case 3 functions as a retainer that retains the angular oscillator 1 relative to the case 3 by using the magnetism generated by the angular oscillator 1.

First magnetic field lines are generated between the first magnetic dipole and the second magnetic dipole. An electromagnetic coil 7 is provided to generate second magnetic field lines that include components perpendicular to the first magnetic lines. In FIG. 2(*a*), the electromagnetic coil 7 is wound about the outer surface of the case 3.

When a current is supplied to the electromagnetic coil 7, the electromagnetic coil 7 generates the second magnetic field lines, thereby oscillating the angular oscillator 1. When a periodic current is supplied to the electromagnetic coil 7, and the current frequency is adjusted such that the frequency of the magnetic field of the coil 7 coincides with the natural frequency of the angular oscillator 1, the angular oscillator 1 resonates and generates a highly efficient oscillating motion. That is, the oscillating system of the centrifugal pump converts the energy supplied by the current into the rotational velocity energy and the potential energy of the magnetic field, and stores the converted energy. When the moment of inertia of the angular oscillator 1 is expressed by I [$Kg \cdot m^2$], and the maximum angular velocity in a single cycle is expressed by $\omega$ [rad/s], the amount of energy stored in the centrifugal pump is expressed by $I\omega^2/2$ [J].

While such resonance is taking place, continuous supply of fluid from the suction pipe 8 to the radial through holes 2 causes the fluid to receive centrifugal force in the radial through holes 2. The fluid is thus continuously discharged to the outside from the angular oscillator 1. That is, the radial through holes 2 are oscillated to apply centrifugal force to the fluid in the radial through holes 2 so that the fluid is moved under pressure and discharged through the pressure feed outlets 2*b*. The energy used for conveying the fluid is the output energy of the oscillating system, and consumed from the oscillating system. The angular oscillator 1 is thus resonated to compensate for the consumed output energy.

As described above, a turbo type centrifugal pump utilizing angular oscillation is obtained by integrally incorporating the mechanism of a resonance oscillation motor into the pump mechanism.

The above described embodiment provides the following advantages (operational effects).

(1) The centrifugal pump causes the angular oscillator 1 to angularly oscillate, so as to apply centrifugal force to fluid in the radial through holes 2 to pressure feed the fluid. That is, the angular oscillator 1 is oscillated by electromagnetic force supplied from the outside of the case 3 in a state where the angular oscillator 1 is mechanically and rotatably supported to the case 3 by the bearing portions 4. This allows the case 3 to be sealed in the structure for applying the force to the angular oscillator 1. For example, unlike a structure in which the angular oscillator 1 is driven by a drive motor from the outside of the case 3 through a rotary shaft extending through the case 3, the present embodiment requires no shaft shielding structure and is suitable for miniaturization.

(2) The angular oscillator 1 is formed simply by forming the radial through holes 2 in a cylindrical magnet. The angular oscillator 1 is therefore easy to manufacture.

(3) The suction pipe 8 pass through the interior of the bearing portions 4, which are partly located in the axial hole 1*a* of the angular oscillator 1. Therefore, the structure for supplying fluid to the radial through holes 2 is formed by effectively utilizing the structure for rotatably supporting the angular oscillator 1. The bearing portions 4 stably support the suction pipe 8.

FIGS. 3(*a*) to 3(*c*) illustrate a centrifugal pump according to a second embodiment.

The hollow portion of a case 13 is cylindrical. That is, the case 13 has an inner circumferential surface 13*a* the size of which is substantially equal to that of the angular oscillator 1. The diameter of the case inner circumferential surface 13*a* is slightly greater than the outer diameter of the angular oscillator 1. To allow the case inner circumferential surface 13*a* to rotatably support the outer circumferential surface 1*b* of the angular oscillator 1, facing portions of these are subjected to mirror coating. That is, no structure like the bearing portions 4, which are partly located in the axial hole 1*a* of the angular oscillator 1, is required to allow the case inner circumferential surface 13*a* to function as a bearing as shown in FIG. 3(*b*). It is sufficient if a distal end 8*a* of the suction pipe 8 can supply fluid into the axial hole 1*a* of the angular oscillator 1.

Outlet openings 5 extend in the circumferential direction along the case inner circumferential surface 13*a*, so as to encompass the reciprocating motion range A (see FIG. 3(*a*)) of the radial through holes 2 in a case where the angular oscillator 1 is angularly oscillated. A discharge port cover 10 closely contacts and covers each outlet opening 5 to achieve fluid-tight sealing between the pressure feed outlet 2*b* of the radial through hole 2 and the case inner circumferential surface 13*a*. A discharge pipe 9 extends outward from each discharge port cover 10. That is, the pressure feed outlets 2*b* cause fluid to flow into the outlet openings 5 through the interior of the discharge port covers 10, while preventing the fluid to leak to the space between the case inner circumferential surface 13*a* and the outer circumferential surface 1*b* of the angular oscillator 1. To maintain the shielding performance against fluid leak of the suction openings 6 and the outlet openings 5, the radii of curvature of the case inner circumferential surface 13*a* and the outer circumferential surface 1*b* of the angular oscillator 1 are adjusted. The centrifugal pump of FIG. 3(*a*) is also driven by supplying a periodic current to the electromagnetic coil 7.

The centrifugal pump of FIG. 3(*a*) further provides the following advantage.

(4) In the centrifugal pump shown in FIG. 2(*a*), the outer circumferential surface 1*b* of the angular oscillator 1 moves in fluid and stirs the fluid. However, the outer circumferential surface 1*b* of the angular oscillator 1 shown in FIG. 3(*a*) has a structure that does not stir fluid, and is thus superior in the energy conversion efficiency. Further, in the case of FIG. 3(*a*), since the suction pipe 8 does not move, the angular oscillation of the angular oscillator 1 is more smooth, and the energy loss is reduced. Also, in FIG. 3(*a*), the clearance between the first magnetic dipole of the angular oscillator 1 and the second magnetic dipole of the case 13 is small, the interaction of the magnetic fields is strong. This increases the natural frequency of the oscillating system and achieves a high output.

Figure 4A:
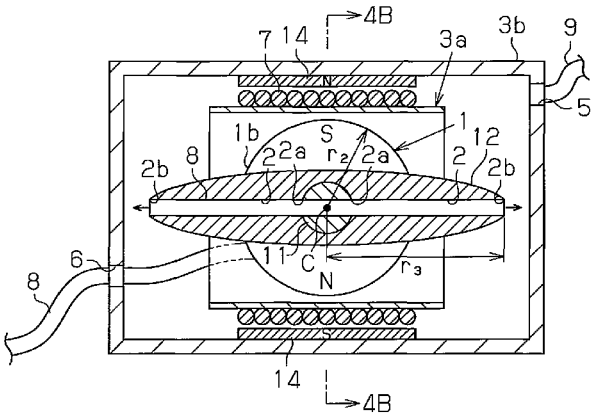
FIG. 4(*a*) is a cross-sectional plan view of a centrifugal pump according to a third embodiment.
Figure 4B:
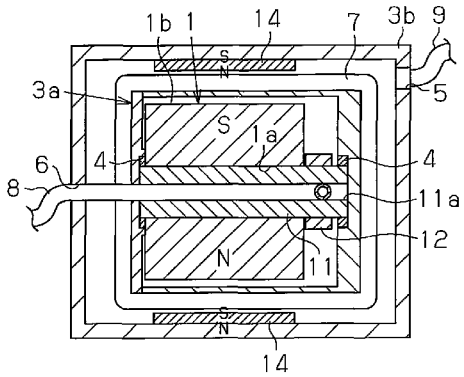

FIGS. 4(*a*) and 4(*b*) illustrate a centrifugal pump according to a third embodiment, which has a simple structure.

A case 3 is formed by a rectangular frame-like inner case 3*a* and an outer case 3*b*, which hermetically accommodates the inner case 3*a*. An outlet opening 5 and a suction openings 6 are formed in the outer case 3*b*. The inner case 3*a* rotatably supports a hollow shaft 11 with a pair of bearings 4. An angular oscillator 1, which is a magnet of a first dipole, and through hole support arms 12 are attached to the hollow shaft 11 so as to rotate integrally. The through hole support arms 12 function as through hole accommodating arms that pass the clearance of the rectangular frame of the inner case 3*a* and extend in the radial direction, so as to project outward from the angular oscillator 1. The hole support arm 12 includes two radial through holes 2 that communicate with the axial hole 11*a* of the hollow shaft 11.

A suction pipe 8 is drawn from the outside to the inside of the outer case 3*b*, and passed through the axial hole 11*a* of the hollow shaft 11. The suction pipe 8 is branched into two, and each branch passes through the corresponding radial through hole 2 to the distal end of the through hole support arm 12. An electromagnetic coil 7 is wounded about the inner case 3*a*. Two stator magnets 14, each serving as a second dipole, or a retainer, are attached to the inner surface of the outer case 3*b*. That is, the outer case 3*b* hermetically accommodates the inner case 3*a*, the electromagnetic coil 7, the stator magnets 14, and the hollow shaft 11. A discharge pipe 9 is attached to the outlet opening 5 of the outer case 3*b*. First magnetic field lines generated by the first dipole and the second dipole extend along vertical direction in each of FIGS. 4(*a*) and 4(*b*).

The device shown in FIGS. 4(*a*) and 4(*b*) further provides the following advantage.

(5) The through hole support arms 12 are used for extending the radial through holes 2, while reducing the outer radius of the angular oscillator 1. The smaller the outer radius of the angular oscillator 1, the smaller the moment of inertia becomes of the angular oscillator 1. Accordingly, the resonant frequency of the angular oscillator 1 can be raised, and a more intense centrifugal force can be generated. In other words, the smaller the outer diameter of the angular oscillator 1, the easier it is to increase the pump output. On the other hand, the longer the radial through holes 2, the easier it is to generate a more intense centrifugal force for the same frequency and to increase the pump output.

According to the structure of the centrifugal pump shown in FIGS. 4(*a*) and 4(*b*), a compact pump requiring neither valve nor shaft shield can be built with the length of one side of approximately 3 cm and the weight of approximately 40 g. The angular oscillator 1 is formed by a hollow neodymium magnet, and has an outer diameter $r_2$ of 8.5 mm, and an inner diameter $r_2$ of 3 mm, and an axial dimension of 15 mm. The suction pipe 8 is formed by bundling two silicone rubber hoses, each having an outer diameter of approximately 1 mm, an inner diameter of 0.4 mm. The electromagnetic coil 7 is a coil of 100 turns of an enameled wire having a diameter of 0.26 mm.

A pulse current of approximately 50 Hz was supplied to the electromagnetic coil 7, and the frequency of the pulse current was sequentially adjusted. At about 70 Hz, the angular oscillator 1 performed angular oscillation while resonating at the natural frequency. The oscillation angle, or the angle of amplitude, was approximately 2 radians. As a result, the angular oscillator 1 functioned as a centrifugal pump and exerted a pumping water level of up to approximately 110 cm. That is, the pump pressure was about 11 kpa. When no pressure load was acting on the discharge pipe 9, the discharge flow rate was approximately 50 ml/min, and the work of the pump was approximately 0.01 W. The water pumping performance to a height of 50 cm was approximately 30 ml/min.

Figure 5A:
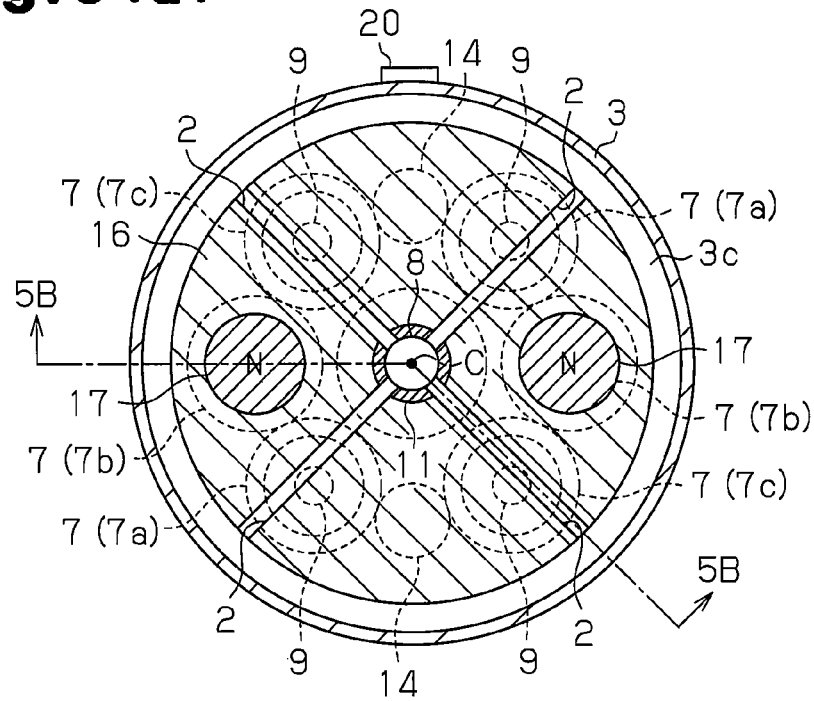
FIG. 5(*a*) is a cross-sectional plan view of a centrifugal pump according to a fourth embodiment.
Figure 5B:
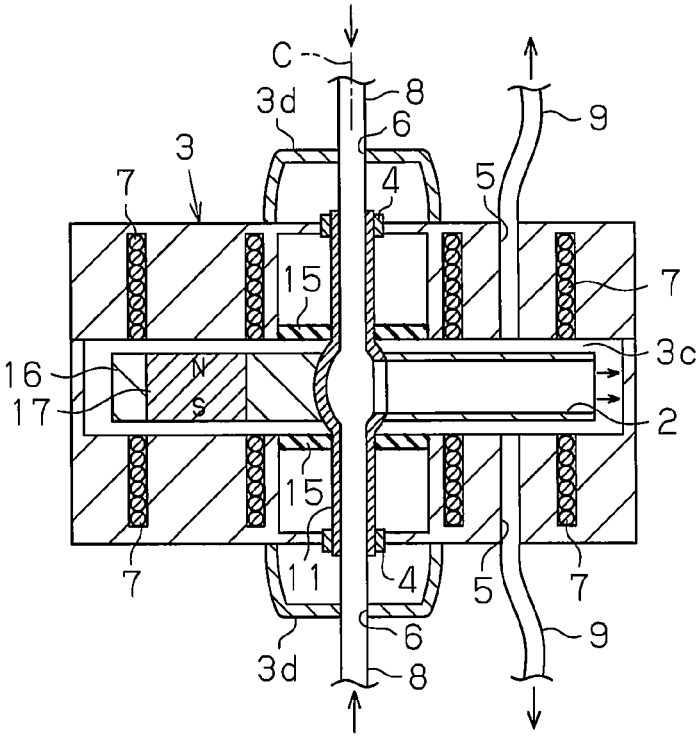

FIGS. 5(*a*), 5(*b*), and 6 illustrate a fourth embodiment, which is suitable for an artificial heart pump. This centrifugal pump has a property of not destroying blood.

As shown in FIGS. 5(*a*) and 5(*b*), a flattened cylindrical case 3 accommodates a hollow shaft 11. Fluid that is discharged from radial through holes 2 connected to the hollow shaft 11 passes through an inner passage 3*c* of the case 3 and flows to discharge pipes 9. The top plate and the bottom plate of the case 3 each have a shaft receiving hole in the center. The circumferential surface of each shaft receiving hole functions as a bearing portion 4 to rotatably support the hollow shaft 11. The inner surfaces of the bearing portions 4 of the top plate and the bottom plate of the case 3 are each covered with a sealing member 15 formed from an elastomeric material, hereinafter referred to as an elastic sealing member 15. The outer surfaces of the bearing portions 4 of the top plate and the bottom plate of the case 3 are each covered with an auxiliary case 3*d*. The hollow shaft 11 extends through the elastic sealing members 15, while the side surface of the hollow shaft 11 is hermetically bonded to the elastic sealing members 15. The elastic sealing members 15 isolate fluid in the case 3 (that is, fluid in the inner passage 3*c*) from the bearing portions 4.

A suction pipe 8 is connected to either end of the hollow shaft 11. Each end of the hollow shaft 11 passes through the corresponding bearing portion 4. Each suction pipe 8 is passed through a suction opening 6 formed in the corresponding auxiliary case 3*d*, while closely contacting and being fixed to the auxiliary cases 3*d*. That is, even if fluid exists outside the auxiliary cases 3*d*, the fluid outside the auxiliary cases 3*d* is isolated from the bearing portions 4 by the auxiliary cases 3*d*.

The device shown in FIGS. 5(*a*) and 5(*b*) further provides the following advantage.

(6) The present embodiment is designed for being embedded in the human body. That is, the bearing portions 4 are sealed by the elastic sealing members 15 and the auxiliary cases 3*d*. As a result, fluid that flows into the centrifugal pump through the suction pipes 8, receives centrifugal force, and is discharged from the discharge pipes 9 does not contact the bearing portions 4. The following description is about case in which the pump of the present embodiment pressure feeds blood, which carries particles such as red blood cells, is used as fluid that carries fine particles, or carrier fluid. In this case, particles contained in the carrier fluid (for example, red blood cells in blood) are prevented from being mashed by the bearing portions 4.

The suction pipes 8 closely contact and are fixed to the auxiliary cases 3*d*, and a portion of the interior of each auxiliary cases 3*d* that corresponds to the suction pipe 8 is smoothly deformed according to angular oscillation of the hollow shaft 11. As a result, the hollow shaft 11 is rotatable relative to the case 3. For example, amber natural rubber or silicone rubber may be used for the elastic sealing member 15.

Further, as shown in FIGS. 5(*a*) and 5(*b*), a flat oscillator disk (rotating disk) 16, which serves as an oscillator, is attached to the hollow shaft 11, so as to rotate integrally with the hollow shaft 11. The oscillator disk 16 is formed of a non-magnetic substance having a small specific gravity. For example, the oscillator disk 16 is formed of plastic. Two oscillator magnets 17, each functioning as a first dipole, are attached to the oscillator disk 16, so as to be spaced by 180° about the axis. The north pole and the south pole of each oscillator magnet 17 are arranged along the axial direction. The two oscillator magnets 17 face in the same direction. For example, the north poles of the two the oscillator magnets 17 face the top plate of the case 3, and the south poles of the oscillator magnets 17 face the bottom plate of the case 3. The oscillator disk 16 functions as an angular oscillator having two first dipoles (17).

The oscillator disk 16 has four radial through holes 2, which are spaced by 90°. Each radial through hole 2 communicates with the interior of the hollow shaft 11, and extends from the inner circumferential surface to the outer circumferential surface of the oscillator disk 16.

Two stator magnets 14 are arranged on the case 3 at an interval of 180°. Further, six electromagnetic coils 7 are attached to the top plate as shown in FIG. 5(*a*). The north poles and the south poles of the two stator magnets face in the same direction, which is opposite to the direction of the oscillator magnets 17. That is, the south poles of the stator magnets 14 face the south poles of the oscillator magnets 17, and the north poles of the stator magnets 14 face the north poles of the oscillator magnets 17. The six electromagnetic coils 7 are arranged so as not to overlap the stator magnets 14. Specifically, four of the six electromagnetic coils 7 are arranged at 90° intervals, and each of these four is at a position displaced from a stator magnet 14 by 45°. The remaining two electromagnetic coils 7 are arranged by avoiding the stator magnets 14, and are each at a position away from an electromagnetic coil 7 by 45°.

Likewise, two stator magnets 14 and six electromagnetic coils 7 are attached to the bottom plate of the case 3. The stator magnets 14 of the top plate of the case 3 and the stator magnets 14 of the bottom plate of the case 3 face each other so as to be attracted to each other. Each magnet in the top plate and a corresponding magnet in the bottom plate of the case 3 form a second dipole. That is, the case 3 has two second dipoles, each arranged in a direction of repelling the two first dipoles of the oscillator disk 16. Thus, the oscillator disk 16 is rotatable about its axis, and is at a resting position when the oscillator magnets 17 are spaced from the stator magnets 14 by 90° about the axis. The electromagnetic coils 7 on the bottom plate of the case 3 each face the corresponding one of the electromagnetic coils 7 on the top plate with respect to the axial direction.

The above described device provides the following advantages.

(7) If the oscillator magnets 17 are arranged close to the axis, it is easy to adjust the angular oscillation of the oscillator disk 16 to obtain a high resonant frequency. On the other hand, when the radius of the oscillator disk 16 is increased, the radial through holes 2 are elongated, so that a great centrifugal force can be applied to the fluid in the radial through holes 2.

This configuration gives pump characteristics to carrier fluid, while preventing particles contained in the carrier fluid in the case 3 from being mashed. That is, the bearing portions 4 are isolated from the carrier fluid by the elastic sealing members 15 and the auxiliary cases 3*d*. That is, the contacting surfaces of the hollow shaft 11 and the suction openings 6 serving as shaft receiving holes is hermetically isolated from the carrier fluid. As a result, the particles in the carrier fluid are prevented from being mashed.

(8) Since the conventional centrifugal pump needs to have a drive source such as a motor outside the case 3, the clearance between the drive source and the shaft needs to be sealed. In contrast, since the drive source of the centrifugal pump of the present embodiment does not need to be located outside the case 3, the hermetic sealing of the case 3 is easy.

The case 3 has a plurality of the outlet openings 5, to each of which a discharge pipe 9 is attached. The interior of the case 3 has a shape that allows fluid to smoothly flow in one direction. As shown by arrows in FIG. 5(*b*), fluid that has been discharged from the outer circumferential surface of the oscillator disk 16 temporarily flows radially inward along the upper surface and the lower surface of the oscillator disk 16, and then enters the discharge pipes 9 to be discharged to the outside of the case 3.

For example, the length of each radial through hole 2 is approximately 3.5 cm. The cross-section of each radial through hole 2 is rectangular, and the total cross sectional area of the four radial through holes 2 is approximately 0.5 $cm^2$. The sizes of and distances between the oscillator magnets 17 and the stator magnets 14 are determined such that the angular oscillator 1 has a resonant frequency that is higher or equal to 40 cycles. The outer diameter and the thickness of the oscillator disk 16 are set to 70 mm and 8 mm, respectively.

The electromagnetic coils 7 are driven periodically. Each cycle is split into multiple phases so that the timing at which each coil is driven and switching of the direction of currents are controlled to facilitate angular oscillation. Table 1 shows one example of control. For purposes of illustration, the six electromagnetic coils 7 are divided into three pairs of coils, or two first coils 7*a*, two second coils 7*b*, and two third coils 7*c*. The coils in each set are separated by 180°. The pattern of excitation of eight phases, which are the zeroth phase to the seventh phase, is shown in Table 1. In table 1, "+" represents a state in which the exited electromagnetic coil 7 is driven to attract the oscillator magnet 17, and "−" represents a state in which the excited electromagnetic coil 7 repels the electromagnetic coil 17.

TABLE 1

| Phase split | First coils 7a | Second coils 7b | Third coils 7b |
|---|---|---|---|
| Zeroth phase | | − | + |
| First phase | | | − |
| Second phase | | | |
| Third phase | | + | − |
| Fourth phase | + | − | |
| Fifth phase | − | | |
| Sixth phase | | | |
| Seventh phase | − | + | |

Figure 6:
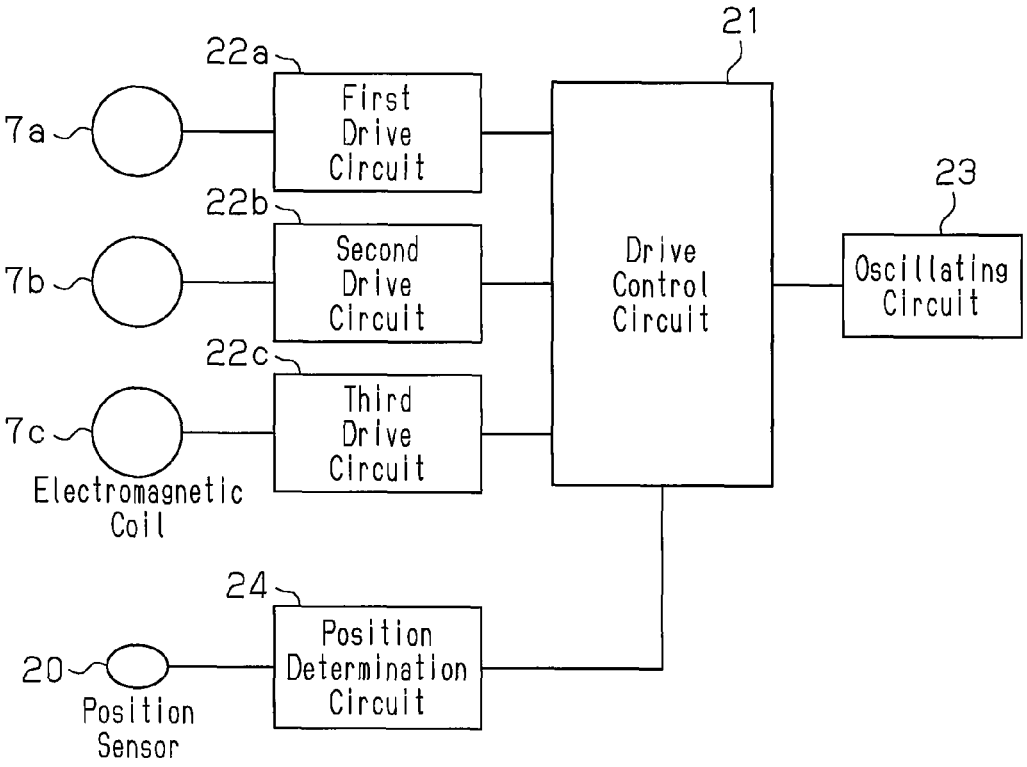
FIG. 6 is a block diagram of a drive control device that drives and controls the centrifugal pump shown in FIG. 5(*a*)

When the pressure load of the centrifugal pump fluctuates, the natural frequency of the oscillator disk 16 also fluctuates. In order to feed the frequency fluctuation of the oscillator disk 16 back to the drive control of the centrifugal pump, a position sensor 20 that detects the position and the rotation direction of the oscillator disk 16 is attached to the case 3 (shown in FIG. 5(*a*)), and a drive control circuit 21 shown in FIG. 6 is used. The drive control circuit 21 uses a first drive circuit 22*a* to drive the first coils 7*a*, a second drive circuit 22*b* to drive the second coils 7*b*, and uses a third drive circuit 22*c* to drive the third coil 37. An oscillating circuit 23 shown in FIG. 6 and the drive control circuit 21 are initially driven at an oscillation frequency of 40 cycles/second with an oscillation angle of approximately 1.5 radian. Thereafter, the drive control circuit 21 receives the detection result of the position sensor 20 through a position determination circuit 24, and switches the control mode such that the oscillation angle becomes approximately 2 radians and the oscillation frequency becomes approximately 40 cycles/second, thereby causing the resonance angular oscillation of the oscillator disk 16 to continue. That is, the drive control circuit 21 sequentially excites the electromagnetic coils 7 as shown in Table 1, thereby causing the resonance oscillation of the oscillator disk 16 to continue.

As a result, the fluid pump shown in FIG. 5(*a*) functions as a liquid pump having a discharge flow rate of 7500 ml/s, in a state having a pressure load of 13 kpa. This liquid pump has a property of not destroying the contents of blood, and is therefore suitable as a blood pump. In other words, the liquid pump can be used as an artificial heart pump.

Figure 7A:
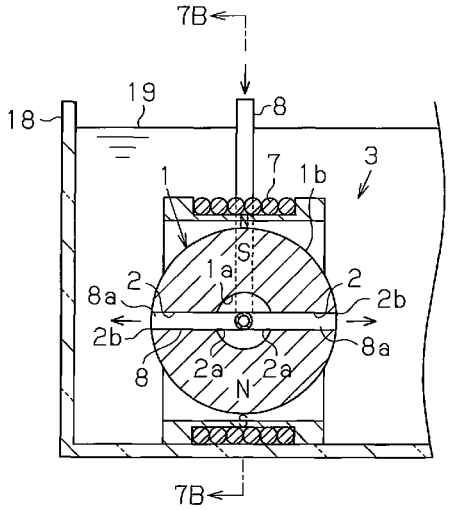
FIG. 7(*a*) is a cross-sectional view of a centrifugal pump according to a fifth embodiment.
Figure 7B:
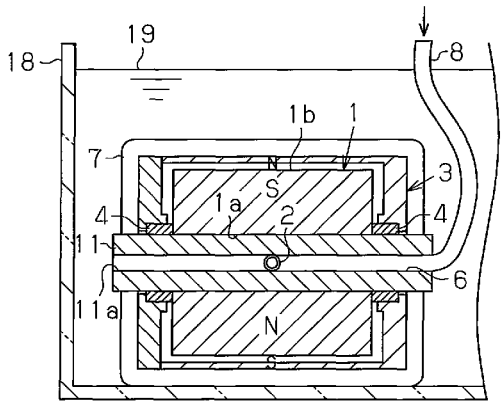

FIGS. 7(*a*) and 7(*b*) illustrate a fifth embodiment, which is suitable as an air pump.

That is, a device shown in FIG. 7(*a*) is capable of injecting air into water with a simple structure. A silicone rubber tube serving as a suction pipe 8 is passed through a hollow shaft 11, so as to extend through an oscillator 1 and reaches radial through holes 2. The device is fixed to the bottom or a side wall of an aquarium 18 such that the distal end of the suction pipe 8 is above the water surface 19.

A part of or the entirety of the angular oscillator 1 is formed of magnet, and the magnetic force of the angular oscillator 1 and the stator magnet 14 attract each other in the vertical direction as viewed in FIG. 7(*a*). With a frequency current being supplied to the electromagnetic coil 7, the frequency is adjusted such that the angular oscillator 1 resonates and performs angular oscillation. Pump pressure generated in the radial through holes 2 by the angular oscillation causes gas, such as air, drawn through the suction pipe 8, to be discharged into water as a great number of fine bubbles. This operation is suitable for an air pump used in an aquarium for fish.

Hereinafter, the operating principles and estimate of pumping performance for the centrifugal pump according to the present invention will be described.

For illustration purposes, the inner diameter and the outer diameter of the angular oscillator 1 are expressed by $r_2$ [m] and $r_2$ [m] as shown in FIG. 1(*a*), respectively. Also, the length from the axis C of the angular oscillator 1 to the distal end of the radial through hole 2 (radial through hole length) is expressed by $r_3$ [m]. Although the radial through hole length $r_3$=the outer diameter $r_2$ in FIG. 1(*a*), the radial through hole length $r_3$>the outer diameter $r_2$ in the case shown in FIG. 4(*a*). The diameter of the radial through hole 2 is expressed by Φ [m]. Since it is possible to provide two or more radial through holes 2, the number of radial through holes 2 in a single angular oscillator 1 is expressed by s [number]. The angular velocity of the angular oscillation changes along a sinusoidal waveform.

The oscillation angle of the angular oscillation of the angular oscillator 1 is expressed by α [radian] (see FIG. 2(*d*)), and the frequency of the angular oscillation is expressed by f [cycles/s]. During angular oscillation, the angular velocity ω [radian/s] changes. The average angular velocity $\omega_1$ satisfies the equation $\omega_1=2\alpha f$. An object in the radial through hole 2 receives centrifugal acceleration a [m/s$^2$]. In a case where the angular velocity in circular motion of a uniform acceleration is expressed by $\omega_1$, an object that is at a center in the radial through hole 2 and away from the center of the cylinder by r [m] receives a centrifugal acceleration a, which satisfies the equation $a=r\omega_1^2$.

In a case where the angular velocity ω in angular oscillation changes along a sine wave, and the average angular velocity in a single cycle is expressed by $\omega_1$, if the phase position of the cycle is θ [radian], and one cycle=2π [radian], the angular velocity ω(θ) relative to the cycle phase position is represented by the following equation: $\omega(\theta)=(\pi/2)\omega_1 \sin\theta$ In this case, the centrifugal acceleration a acting on an object in the radial through hole 2 at a position away from the cylinder enter by r [m] is represented by the following equation:

$$a(\theta)=(\pi^2/4)r\omega_1^2 \sin^2\theta$$

The average centrifugal acceleration $a_1$ in one cycle is obtained by averaging the integral of one cycle, and represented by $a_1=(\pi^2/4)r\omega_1^2$.

Therefore, it is assumed that the liquid filling the radial through hole 2 receives, from the center to a side of the cylinder, the averaged centrifugal acceleration $a_1=(\pi^2/4)r\omega_1^2=\pi^2\cdot r\alpha^2 f^2$.

When the cross-sectional area of the radial through hole 2 is expressed by S [m$^2$], $S=\pi s(\Phi/2)^2$. The volume y [m$^3$] of the liquid in the radial through hole satisfies the equation $y=Sr_3$. When the liquid specific gravity is expressed by g [g/cm$^3$], and the weight of the liquid in the radial through holes 2 is expressed by m [kg], m=1000 gy. The liquid in the radial through holes 2 receives centrifugal force F [N] directed from the cylinder center to a side of the cylinder. If averaged, F [N]=$ma_1$, that is, $F=62.5\pi^2 gSr_3^2\alpha^2 f^2$. The centrifugal force is pump discharging force, and if the pump pressure is expressed by A [N/m$^2$], A=F/S, that is, $A=250\pi^2 gr_3^2\alpha^2 f^2$. Since A [N/m$^2$] is equal to A [pa], if the pump pressure is expressed by B [kpa], B=A/1000.

The average amount of time t [s] required for liquid to pass through the radial through hole 2 is $t=\sqrt{(r_3/a_1)}$, and the averaged speed v [m/s] of liquid to pass through the radial through hole 2 is $v=r_3/t$. When the pressure load at the output side of the pump is zero, the displaced volume per second is expressed by Y [m$^2$/s] and the displaced weight per second is expressed by M [kg/s], Y=y/t and M=m/t. The discharge flow rate Z [ml/min] per minute when the pressure load is zero is $Z=6\times10^7$ Y. When the work per second consumed through the pump operation is expressed by P [N·m/s], P=Fv, and the unit is [N·m/s], or [W].

Three factors of the pump output, that is, the pump pressure B [kpa], the discharge flow rate Z [ml/min] per minute when the pressure load is zero, and the pump work P [W] are expressed by the following parameters of the pump. The pump parameters include the length $r_3$ [m] of the radial through hole, the diameter Φ [m] of the radial through hole, the number s of the radial through holes, the oscillation angle α [radian] of the angel oscillation, the frequency f of the radial oscillation [cycle/s], and the liquid specific gravity g [g/cm$^3$].

$$B=(\pi^2/4)gr_3^2\alpha^2 f^2$$

$$Z=7500000\pi^2 s\Phi^2 r_3\alpha f$$

$$P=31.25\pi^4 sg\Phi^2 r_3^3\alpha^3 f^3$$

These three equations B, Z, P explicitly show that the pump pressure B is proportional to the square of the radial through hole length $r_3$, the square of the oscillation angle α, and the square of the frequency f, that the discharge flow rate Z [ml/min] per minute when the pressure load is zero is proportional to the radial through hole length $r_3$, the oscillation angle α, and the frequency f, and that the pump work P is proportional to the cube of the radial through hole length $r_3$, the cube of the oscillation angle α, and the cube of the frequency f. Further, the discharge flow rate Z per minute when the pressure load is zero and that the pump work P are both proportional to the number of the radial through holes 2 and to the square of the diameter Φ of the radial through hole 2.

Further, the flow rate in a case where there is pressure load $A_1$ [pa] is calculated. A corrected pump pressure obtained by subtracting the pressure load is expressed by $A_2$ [pa], a corresponding corrected centrifugal force is expressed by $F_2$ [N], and a corrected centrifugal acceleration is expressed $a_2$ [m/s$^2$]. In this case, $A_2=A-A_1$, $F_2=A_2S$, and $a_2=F_2/m$.

In this case, when a corrected average amount time required for liquid to pass through the radial through hole 2 is expressed by $t_2$, $t_2=\sqrt{(r_3/a_2)}$. The corrected displaced volume per second is expressed by $Y_2$ [m$^3$]$=y/t_2$, and the correction flow rate per minute $Z_2$ [ml/min]$=60000000Y_2$.

This is expressed by the pump parameters and the pressure load $A_1$.

$$Z_2=1500000\pi s\Phi^2\sqrt{(25\pi^2 r_3^2\alpha^2 f^2-A_1/10g_2)}$$

By substituting concrete numbers into the above equations, the pump performance can be calculated. Table 2 shows examples of substitution. Table 2 shows calculations in a case where the liquid handled is water having a specific gravity of 1.

TABLE 2

| Parameters | sign | unit | condition 1 | condition 2 | condition 3 | condition 4 | condition 5 | condition 6 |
|---|---|---|---|---|---|---|---|---|
| Radial through hole length | $r_3$ | m | 0.01 | 0.015 | 0.015 | 0.035 | 0.005 | 0.04 |
| Radial through hole diameter | Φ | m | 0.001 | 0.0004 | 0.001 | 0.004 | 0.0001 | 0.002 |
| Number of radial through holes | s | number | 1 | 2 | 8 | 4 | 4 | 10 |
| Oscillation angle | α | radian | 1 | 2 | 2 | 2 | 2 | 2 |
| Frequency | f | cycle/sec. | 100 | 70 | 70 | 40 | 200 | 50 |
| Output factors | sign | unit | Output 1 | Output 2 | Output 3 | Output 4 | Output 5 | Output 6 |
| Pump pressure | B | kpa | 2.4 | 10.8 | 10.8 | 19.3 | 9.8 | 39.4 |
| Discharge flow rate when pressure load is zero | Z | ml/min. | 73 | 49 | 1242 | 13251 | 5 | 11831 |
| Pump work | P | W | 0.003 | 0.009 | 0.22 | 4.2 | 0.0009 | 7.7 |
| Load factors | sign | unit | Load output 1 | Load output 2 | Load output 3 | Load output 4 | Load output 5 | Load output 6 |
| Pressure load | $B_1$ | kpa | 1 | 5 | 7 | 13 | 5 | 15 |
| Discharge flow rate with pressure load | $Z_2$ | ml/min. | 57 | 36 | 741 | 7580 | 4 | 9313 |

In Table 2, Condition 1, Output 1, and Load output 1 represent a case where the length $r_3$ and the diameter Φ of the radial through hole 2 are 1 cm and 1 mm, and resonant angular oscillation of an oscillation angle of 1 radian was caused at 100 cycles. In this case, the pump pressure, or the output, was 2.4 kpa, and the discharge flow rate with no pressure load was 73 ml/min. Further, the pump output was 0.003 W, and the discharge flow rate with a pressure load of 1 kpa was 57 ml/min.

Condition 2 corresponds to the embodiment shown in FIG. 4(*a*), which is described above. Condition 3 corresponds to the performance of a micropump applicable to cooling of PC servers and indicates that the size of such a pump can be as small as 3 cm. Condition 4 corresponds to the performance of an artificial heart pump. Condition 5 corresponds to an example of performance applicable to a micropump having a size of 1 cm. Condition 6 corresponds to an example of performance applicable to a micropump having a size of 8 cm.

In this manner, Table 2 shows that the following pump parameters are obtained when the length of the radial through hole 2 is changed in a range between 1 cm to 4 cm, the oscillation angle is changed in a range between 1 radian to 2 radians, the cycle of angular oscillation is changed in a range between 50 cycles and 200 cycles. The pump is adjustable in a wide range of parameters. That is, the pump pressure can be adjusted between 2 kpa and 40 kpa, the flow rate with no pressure with load 5 ml/min. to 13000 ml/min., and the work of the pump is between 1 mW to 8 mW.

The above described embodiments may be modified as follows.

The direction in which each radial through hole 2 extends is not limited to a radial direction with respect to the angular oscillator 1, but may be inclined or bent at one point. In other words, any flow passages may be used as long as fluid in the passage receives centrifugal force generated by reciprocating rotation of the angular oscillator 1 and is moved under pressure to the outlet.

The number of the radial through holes 2 is not limited to two, but may be one, or three or more.

1 . . . angular oscillator
1*a* . . . axial hole.
1*b* . . . outer circumferential surface
2 . . . radial through hole forming pressure feed passage
2*a* . . . pressure feed inlet
2*b* . . . pressure feed outlet
3, 13 . . . case

3*c* . . . inner passage
4 . . . bearing portion
5 . . . discharge opening
6 . . . suction opening
7 . . . electromagnetic coil
8 . . . suction pipe
9 . . . discharge pipe
10 . . . discharge port cover
11 . . . hollow shaft
12 . . . hole support arm
13*a* . . . case inner circumferential surface
14 . . . stator magnet forming retaining portion and second magnetic dipole, respectively
15 . . . sealing member
16 . . . oscillator disc
17 . . . oscillator magnet forming first magnet dipole
18 . . . aquarium
19 . . . water surface
20 . . . position sensor
21 . . . drive control circuit
22*a* . . . first drive circuit
22*b* . . . second drive circuit
22*c* . . . third drive circuit
23 . . . oscillating circuit
24 . . . position determination circuit

The invention claimed is:

1. An angular oscillation centrifugal pump comprising:

a case;

an angular oscillator accommodated in the case and rotatable in a reciprocating manner, the angular oscillator having a first magnetic dipole and a pressure feed passage, the pressure feed passage having a pressure feed inlet for receiving fluid and a pressure feed outlet through which the fluid is discharged;

a retaining portion that is provided in the case to retain the angular oscillator, the retaining portion retaining the angular oscillator based on magnetic force generated by the first magnetic dipole and including a second magnetic dipole or a magnetic body, the angular oscillator being oscillatable relative to the retaining portion, and the magnetic force defining a rest point of the oscillation of the angular oscillator and a natural frequency of the oscillation, wherein the natural frequency is adjusted by changing at least one of the shapes, arrangement, and the intensity of the first magnetic dipole and the second magnetic dipole, wherein the natural frequency of the oscillation is determined by a restoring force based on magnetic forces of the first and second magnetic dipoles, wherein the natural frequency is not determined by a torsional stiffness; and an electromagnetic coil provided in the case, wherein, when a current that is synchronized with the natural frequency is supplied to the electromagnetic coil, the angular oscillator is resonated, and as a result, the fluid in the pressure feed passage receives centrifugal force and is discharged from the pressure feed outlet.

2. The angular oscillation centrifugal pump according to claim 1, wherein the angular oscillator rotates about an axis and has an axial hole extending along the axis, the pressure feed passage radially extending outward from the axial hole.

3. The angular oscillation centrifugal pump according to claim 2, wherein the angular oscillator includes a hollow shaft having the axial hole and an oscillator disk attached to the hollow shaft to rotate integrally, the oscillator disk having a radial through hole that defines the pressure feed passage, and the oscillator disk having the first magnetic dipole, and wherein the electromagnetic coil and the second magnetic dipole are arranged in such manner as to face the oscillator disk in a direction along the axis.

4. The angular oscillation centrifugal pump according to claim 3, wherein the case defines therein an inner passage for causing the fluid discharged from the pressure feed passage to flow to the outside, and wherein the angular oscillation centrifugal pump further comprises:

a bearing portion rotatably supporting the angular oscillator in the case; and an elastic sealing member hermetically sealing the bearing portion from the inner passage of the case.

5. The angular oscillation centrifugal pump according to claim 3, wherein the electromagnetic coil is one of a plurality of electromagnetic coils arranged in the circumferential direction of the oscillator disk, wherein a position sensor for detecting the position and the rotation direction of the oscillator disk is provided in the case, and wherein the angular oscillation centrifugal pump is connected to a drive control circuit that receives a detection result of the position sensor, the drive control circuit sequentially exciting the electromagnetic coils, thereby causing the resonance oscillation of the oscillator disk to continue.

6. The angular oscillation centrifugal pump according to claim 2, wherein the angular oscillator has an outer circumferential surface encompassing the axis, the case having a case inner circumferential surface that rotatably supports the outer circumferential surface of the angular oscillator.

7. The angular oscillation centrifugal pump according to claim 6, wherein the pressure feed outlet opens in the outer circumferential surface of the angular oscillator, wherein a case has a discharge port cover that hermetically seals a space between the pressure feed outlet and the case inner circumferential surface, the discharge port cover extending in the circumferential direction along the case inner circumferential surface, so as to encompass reciprocating motion range of the pressure feed outlet in a case where the angular oscillator is angularly oscillated, and wherein a discharge pipe extends from the discharge port cover, with fluid discharged from the pressure feed outlet being discharged to the outside of the case through the discharge pipe.

8. The angular oscillation centrifugal pump according to claim 1, wherein the angular oscillator includes a radially extending radial through hole support arm having a radial through hole that defines the pressure feed passage, and the radial through hole support arm is formed to extend further radially outward than the angular oscillator.

9. The angular oscillation centrifugal pump according to claim 1, further comprising a suction pipe that extends from outside of the case and is connected to the interior of the axial hole of the angular oscillator, the pump functioning as an air pump that injects air drawn through the suction pipe into a liquid.

10. An angular oscillation centrifugal pump comprising:

a case;

an angular oscillator accommodated in the case and rotatable in a reciprocating manner, the angular oscillator having a first magnetic dipole and a pressure feed passage, the pressure feed passage having a pressure feed inlet for receiving fluid and a pressure feed outlet through which the fluid is discharged, wherein the angular oscillator rotates about an axis and has an axial hole extending along the axis, the pressure feed passage radially extending outward from the axial hole;

the angular oscillator comprising a hollow shaft having the axial hole and an oscillator disk attached to the hollow shaft to rotate integrally, the oscillator disk having a radial through hole that defines the pressure feed passage, and the oscillator disk having the first magnetic dipole, and wherein an electromagnetic coil and a second magnetic dipole are arranged in such manner as to face the oscillator disk in a direction along the axis;

a retaining portion that is provided in the case to retain the angular oscillator, the retaining portion retaining the angular oscillator based on magnetic force generated by the first magnetic dipole and including a second magnetic dipole or a magnetic body, the angular oscillator being oscillatable relative to the retaining portion, and the magnetic force defining a rest point of the oscillation of the angular oscillator and a natural frequency of the oscillation; and an electromagnetic coil provided in the case, wherein, when a current that is synchronized with the natural frequency is supplied to the electromagnetic coil, the angular oscillator is resonated, and as a result, the fluid in the pressure feed passage receives centrifugal force and is discharged from the pressure feed outlet; and wherein the case defines therein an inner passage for causing the fluid discharged from the pressure feed passage to flow to the outside;

a bearing portion rotatably supporting the angular oscillator in the case; and an elastic sealing member hermetically sealing the bearing portion from the inner passage of the case.

* * * * *